US012595541B2

(12) United States Patent
Link et al.

(10) Patent No.: US 12,595,541 B2
(45) Date of Patent: Apr. 7, 2026

(54) HOT DIP COATING DEVICE AND METHOD

(71) Applicant: TATA STEEL NEDERLAND TECHNOLOGY B.V., Velsen-Noord (NL)

(72) Inventors: Jeroen Martijn Link, Bakkum (NL); Jaap Peter Van Eenennaam, Heiloo (NL); Nico Noort, Heemskerk (NL); Eduard Antonie Hermanus Van Den Heuvel, Santpoort-Zuid (NL); Nanda Sintia Mandagi, Maarssen (NL)

(73) Assignee: TATA STEEL NEDERLAND TECHNOLOGY B.V., Velsen-Noord (NL)

( * ) Notice: Subject to any disclaimer, the term of this patent is extended or adjusted under 35 U.S.C. 154(b) by 475 days.

(21) Appl. No.: 18/360,983

(22) Filed: Jul. 28, 2023

(65) Prior Publication Data

US 2024/0018639 A1 Jan. 18, 2024

Related U.S. Application Data

(62) Division of application No. 16/625,188, filed as application No. PCT/EP2018/067637 on Jun. 29, 2018, now Pat. No. 11,761,073.

(30) Foreign Application Priority Data

Jun. 30, 2017 (EP) ..... 17179104

(51) Int. Cl.
*C23C 2/20* (2006.01)
*C23C 2/00* (2006.01)
(Continued)

(52) U.S. Cl.
CPC ..... *C23C 2/20* (2013.01); *C23C 2/00344* (2022.08); *C23C 2/0035* (2022.08); *C23C 2/004* (2022.08);
(Continued)

(58) Field of Classification Search
None
See application file for complete search history.

(56) References Cited

U.S. PATENT DOCUMENTS 3,667,425 A 6/1972 Bozeman et al.
4,237,685 A * 12/1980 Pelagio ..... D02G 3/18 57/328
(Continued)

FOREIGN PATENT DOCUMENTS

CN 205205214 U 5/2016
EP 1063314 A1 12/2000
(Continued)

OTHER PUBLICATIONS

International Search Report and Written Opinion mailed Aug. 20, 2018 for PCT/EP2018/067637 to Tata Steel Nederland Technology B.V. filed Jun. 29, 2018.

*Primary Examiner* — Jethro M. Pence
(74) *Attorney, Agent, or Firm* — Vorys, Sater, Seymour and Pease LLP; Maryellen Feehery Hank; Anthony P. Venturino

(57) ABSTRACT

A hot dip coating device to provide a metal coating on a moving metal sheet, containing a liquid bath of metal coating material in use. The metal coating material on the moving metal sheet in use, including a container for the liquid bath, a guide or sink roll in the container below liquid bath surface level in use to guide the moving metal sheet through the bath, and a gas knife, above the liquid bath in use, having an outlet to project wiping gas on the metal coating on the metal sheet. At least one supporting roll with the guide or sink roll in use influence metal sheet shape in its width direction at the gas knife location. The one supporting roll is above liquid bath surface level to operate on the metal sheet before the metal sheet enters the bath.

10 Claims, 4 Drawing Sheets

(51) Int. Cl.
*C23C 2/06* (2006.01)
*C23C 2/12* (2006.01)
*C23C 2/40* (2006.01)

(52) U.S. Cl.
CPC ..... *C23C 2/06* (2013.01); *C23C 2/12* (2013.01); *C23C 2/40* (2013.01)

(56) References Cited

U.S. PATENT DOCUMENTS 4,330,574 A 5/1982 Pierson et al.
4,466,999 A * 8/1984 Leonard ..... C23C 2/022 427/329
4,519,337 A 5/1985 Ono et al.
5,320,753 A 6/1994 Keillor et al.
5,571,328 A 11/1996 Newland
5,702,528 A * 12/1997 Paramonov ..... C23C 2/00342 118/623
6,341,955 B1 1/2002 Ueno et al.
9,004,000 B2 * 4/2015 Koga ..... C23C 2/004 118/62
9,021,982 B2 * 5/2015 Koga ..... B05C 3/12 118/62
9,279,199 B2 * 3/2016 Matsumoto ..... B32B 5/12
9,834,834 B2 * 12/2017 Yamauchi ..... B05C 3/04
11,248,288 B2 * 2/2022 Yonekura ..... B05C 3/125
11,685,984 B2 * 6/2023 Dubois ..... C23C 2/00344 118/63
2010/0080889 A1 4/2010 Hardy et al.
2013/0239884 A1 9/2013 Koga
2015/0376758 A1 * 12/2015 Bergen ..... C23C 28/028 148/531
2023/0265539 A1 * 8/2023 Minami ..... C21D 9/561 148/525
2024/0352568 A1 * 10/2024 Nagai ..... C23C 2/00

FOREIGN PATENT DOCUMENTS

EP 2634284 A1 9/2013
GB 2517622 A 2/2015
JP S59197554 A 11/1984
JP H01263251 A 10/1989
JP H02054746 A 2/1990
JP H03166354 A 7/1991
JP H05156417 A 6/1993
JP H0941107 A 2/1997
JP 2000273610 A 10/2000
JP 2002038247 A 2/2002
JP 2012107322 A 6/2012

* cited by examiner

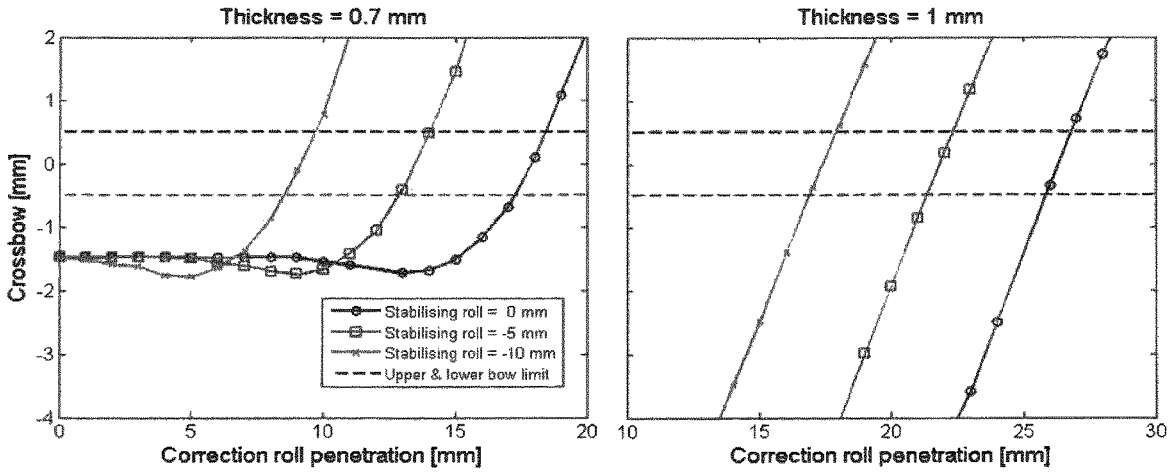
Fig. 4. Crossbow for different settings in the configuration of figure 2.
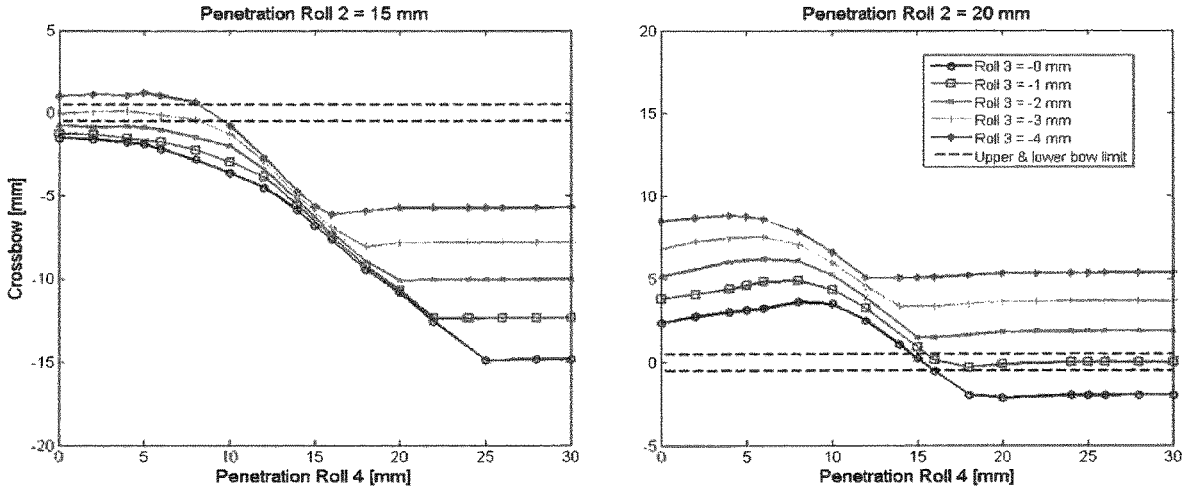
Fig.5. Crossbow for different settings in the configuration of figure 3.

HOT DIP COATING DEVICE AND METHOD

CROSS-REFERENCE TO RELATED APPLICATIONS

This is a divisional of U.S. patent application Ser. No. 16/625,188, filed Dec. 20, 2019, which is a § 371 National Stage Application of International Application No. PCT/EP2018/067637 filed on Jun. 29, 2018, claiming the priority of European Patent Application No. 17179104.9 filed on Jun. 30, 2017.

FIELD OF THE INVENTION

The invention relates to a hot dip coating device to provide a metal coating on a moving metal sheet, containing a liquid bath of metal coating material in use, wherein the metal coating material is to be provided on the moving metal sheet in use, comprising a container for the liquid bath, at least a guide or sink roll that is provided in the container below surface level of the liquid bath in use to guide the moving metal sheet through the bath, and a gas knife that is provided above the liquid bath in use, said gas knife having an outlet to project wiping gas on the metal coating provided on the metal sheet that in use passes along the gas knife, and wherein at least one supporting roll is provided which together with the guide or sink roll in use influence a shape of the metal sheet in its width direction at least at the location of the gas knife. The invention also relates to a method of coating a moving metal sheet.

In the context of the invention, the metal sheet is also called metal strip, usually having a length of at least a few hundred meters, a width of up to approximately 2 meters and a thickness of at most a few millimetres.

BACKGROUND OF THE INVENTION

GB-A-2 517 622 discloses a hot dip coating device, comprising a liquid bath of metal coating material to be provided on the metal sheet, wherein a guide or sink roll is provided below surface level of the liquid bath to guide the moving metal sheet through the bath, and wherein a gas knife is provided above the liquid bath, said gas knife having an outlet to project wiping gas on the metal coating provided on the metal sheet that passes along the gas knife. Although GB-A-2 517 622 does not disclose it, normally at least one supporting roll is provided in the liquid metal bath between the sink roll and the surface level of the liquid bath, at the side of the gas knife. As mentioned the at least one supporting roll and the guide or sink roll influence the shape of the metal sheet in its width direction at the location of the gas knife. In practice this means that the at least one supporting roll is embodied in the form of a stabilizer roll and/or a correcting roll within the metal bath between the sink roll in the bath and the gas knife above the bath.

Usually the moving metal sheet or strip is introduced into the liquid bath of metal through a snout which ends in the liquid bath of metal, as schematically indicated in the figure of GB-A-2 517 622. Before the metal strip is coated with the metal in the liquid bath, the metal strip is usually heated in a furnace because the strip needs to be on bath temperature before coating and because in case of cold rolled strip the metal is full hard and needs to be recrystallized. This is especially the case for steel strip. To guide the metal strip through the furnace and into the snout, several rolls are present in the furnace. The last roll or rolls to guide the metal strip into the snout are a deflection roll or a bridle. Often two bridles are present to guide the metal strip and keep tension on the metal strip.

A first purpose of the at least one supporting roll is to acquire a desired shape of the metal sheet. This is done with what is termed the correcting roll or rolls.

A second purpose of the at least one supporting roll is to align the metal sheet with the gas knife. Alignment between the gas knife and the metal sheet is necessary, because the diameter of the rolls within the liquid metal bath changes due to roll wear. This changes a horizontal exit position of the metal sheet. The roll or rolls used to align the gas knife and the metal sheet are termed stabilizer rolls.

In many cases, in practice both a correcting roll and a stabilizer roll are used, which are both provided in the liquid metal bath.

A problem with the known hot dip coating devices is that the wear of the rolls within the liquid metal bath requires regular maintenance. This not only adversely affects the cost of operation of the hot dip coating device, but also goes at the expense of the device's productivity because of the unavoidable loss of production time due to the required maintenance.

Another problem with the known supporting roll or rolls within the liquid metal bath is that the wet frictional contact of the rolls with the moving metal sheet in the liquid bath causes the rolls to rotate, which leads to possible metal sheet damage due to slippage between the rolls and the moving metal sheet. Also from a design consideration this way of driving the supporting roll or rolls forms a limitation in the processing speed of the device, since the speed of the moving metal sheet is limited to the point that slippage with reference to the supporting roll or rolls is at the verge of occurring.

Still another problem with the submerged supporting roll or rolls is that the flow of liquid metal in the liquid metal bath is influenced by the rotating rolls and that the flow pattern within the liquid metal bath may cause impurities in the bath to settle on the surface of the moving metal sheet.

Finally there are limitations in the design of the known coating device, which are intertwined with the required constructional support for the supporting roll or rolls which support is usually provided above bath level where space is limited because of the gas knife which should be close to the surface level of the metal bath.

SUMMARY OF THE INVENTION

It is an object of the invention to reduce or remove the disadvantages of the prior art device and to propose a solution wherein the above-mentioned problems are partly or wholly removed.

It is a further object of the invention to provide a method of coating a moving metal sheet by which the above problems are partly or wholly solved.

According to the invention in use the at least one supporting roll is positioned above surface level of the liquid bath on a position enabling it to operate on the metal sheet before the metal sheet enters the liquid bath. The inventors have surprisingly found that with this measure it is not only possible to maintain a desired shape of the metal sheet at the location of the gas knife for which the at least one supporting roll is used, but to achieve this while gaining advantages in terms of reduced wear of the at least one supporting roll and increased production capacity of the hot dip coating device. Surprisingly it is also found unnecessary to position the at least one supporting roll at a position below surface level of the liquid metal bath, before the metal sheet leaves the metal bath. On the contrary, the at least one supporting roll can be functionally effective by positioning it at the location before the metal sheet enters the liquid metal bath and before it is guided along or around the guide or sink roll in the liquid metal bath.

Usually the dip coating device comprises a snout through which during use the metal sheet moves into the liquid bath. This is for instance shown in GB-A-2 517 622. Advantageously the at least one supporting roll is positioned within the snout, so that it can be positioned close to the surface level of the liquid metal bath. This improves the effectivity of the supporting roll or rolls.

Another advantage that comes within reach with the invention is to provide the at least one supporting roll with a motor drive, which obviates the need to rely on the frictional contact between the supporting roll and the moving metal sheet. Accordingly the risk of damaging the metal sheet by slippage between the supporting roll and the metal sheet is reduced.

Preferably the gas knife is movable in length direction of the coating device, that is the direction of the moving metal sheet in use. By this provision it is possible to align the metal sheet with the gas knife as is required when continued operation results into noticeable wear of the dimensions of the roll or rolls.

It is preferred when the gas knife is provided with a positioning system to position the gas knife in relation to the moving metal strip. By using the positioning system the gas knife will be kept in the right position relative to the guide or sink roll during the coating of the metal sheet.

Desirably further the guide or sink roll is movable vertically and/or horizontally in the liquid bath. By this measure it is possible to align the moving metal sheet with reference to the snout it passes through, and avoid its contact with the snout walls.

It is preferred that the at least one supporting roll is removably mounted within the snout to accommodate its replacement and/or maintenance.

All in all best results are achieved, particularly in product quality of the processed metal sheet, by securing that in use the guide or sink roll is the only roll below surface level of the liquid bath.

The inventors have found it preferable that the device of the invention has two supporting rolls, at least one of which is movable to and from the metal sheet.

According to a preferred embodiment the device has three supporting rolls, at least one of which is movable to and from the metal sheet in use. In that way, for instance two rolls can be positioned at one side of the moving metal sheet and the third roll can be positioned at the other side of the moving metal sheet, such that the moving metal sheet is pressed against all three rolls.

Optimal results are however achievable when the device has four supporting rolls, at least one of which is movable to and from the metal sheet in use. The inventors have found this by using four rolls it is possible to exert required bending forces on the moving metal sheet.

According to a second aspect of the invention there is provided a method of coating a moving metal sheet using a hot dip coating device according to the first aspect of the invention, wherein a metal sheet is moved over at least one supporting roll before entering a liquid bath of metal in the container of coating device, wherein the guide or sink roll is the only roll in the liquid bath of metal.

By using this method it is possible to maintain a desired shape of the metal sheet at the location of the gas knife, while the design and maintenance of the coating device is easier, and the production of coated metal sheet is less hampered.

For coating a metal sheet it is preferred when the liquid bath of metal is a liquid bath of zinc or zinc alloy, preferably a zinc aluminium alloy, zinc magnesium alloy or zinc aluminium magnesium alloy, or wherein the liquid bath of metal is a liquid bath of aluminium or aluminium alloy, preferably an aluminium silicon alloy. These are the main coating types for coating metal sheet.

According to a preferred embodiment at least one of the supporting rolls is movable to or from the moving metal sheet, controlled by a device for measuring the travers shape of the coating when the metal sheet moves downstream of the gas knife. By measuring the travers shape of the coating on the metal sheet and using this as input for moving one or more of the supporting rolls, a feed-back loop is introduced by which the thickness distribution of the coating over the width direction of the metal sheet can be controlled.

According to another preferred embodiment at least one of the supporting rolls is movable to or from the moving metal sheet, controlled by a device for measuring the travers shape of the metal sheet when the metal sheet moves downstream of the gas knife. In this embodiment, the thickness and form of the metal sheet itself is measured and controlled by a feed-back loop. The travers shape of the metal sheet determines the traverse shape of the coating.

BRIEF DESCRIPTION OF THE DRAWINGS

The invention will hereinafter be further elucidated with reference to the drawing of an exemplary embodiment of an hot dip coating device according to the invention that is not limiting as to the appended claims.

In the Drawings:

FIG. 4 shows graphs representing the shape of the metal sheet with different settings of the supporting rolls in the embodiment of FIG. 2; and FIG. 5 shows graphs representing the shape of the metal sheet with different settings of the supporting rolls in the embodiment of FIG. 3.

Whenever in the figures the same reference numerals are applied, these numerals refer to the same parts.

DETAILED DESCRIPTION OF THE PREFERRED EMBODIMENTS

Figure 1:
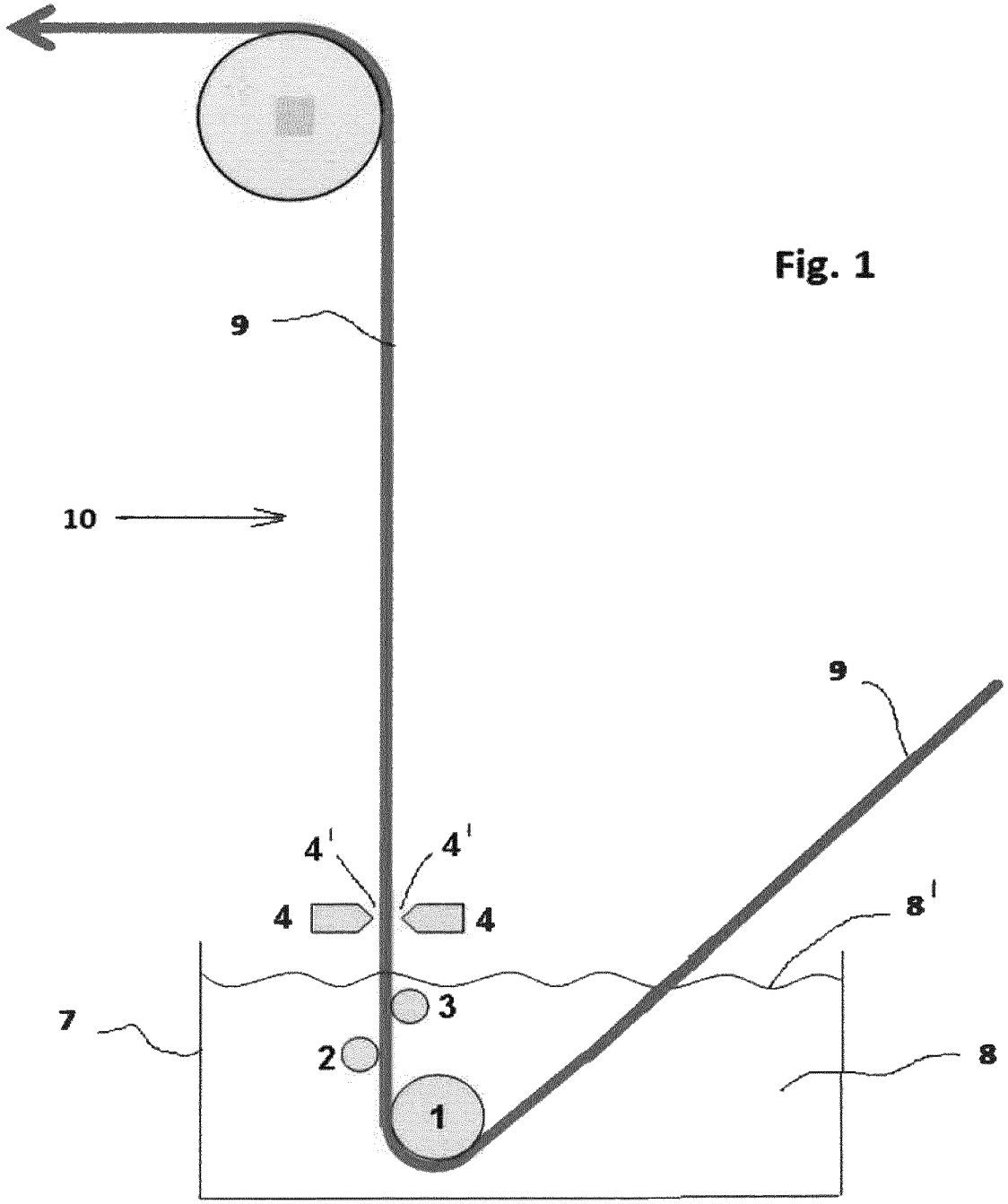
FIG. 1 shows a hot dip coating device according to the prior art.

Making reference first to FIG. 1 it shows a hot dip coating device 10 to provide a metal coating on a moving metal sheet 9, comprising a liquid bath 8 of metal coating in a container 7 to be provided on the metal sheet 9, wherein a guide or sink roll 1 is provided below surface level 8' of the liquid bath 8 to guide the moving metal sheet 9 through the bath 8. A gas knife 4 is provided above the liquid metal bath 8. Said gas knife 4 has an outlet 4' to project wiping gas on the metal coating provided on the metal sheet 9 while it passes along the gas knife 4. The wiping by the gas knife 4 determines the thickness of the coating on the metal sheet 9.

It is of prime importance that the coating process executed with the hot dip coating device 10 as shown in the drawing, results into an uniform coating thickness for appearance quality and corrosion resistance of the coated metal sheet 9. The coating thickness depends inter alia on the distance between the gas knife 4 and the metal sheet 9. As the distance of the gas knife 4 to the metal sheet 9 increases, also coating thickness increases. The coating thickness variations on the metal sheet 9 can be found either in travelling direction of the metal sheet 9 or in its width direction or both. The variation in the travelling direction is usually attributed to vibration of the metal sheet 9, while the variation of the coating thickness in the width direction is attributed to a phenomenon that is called crossbow.

The coating thickness variations due to crossbow are normally counteracted by using a set of supporting rolls 2, 3 located behind the sink roll 1 when seen in processing direction of the metal sheet 9. In FIG. 1 this is shown in that supporting rolls 2, 3 that are embodied as a correction roll 2 and a stabilizer roll 3 are provided in the liquid metal bath 8. Together with the guide or sink roll 1, said correction roll 2 and stabilizer roll 3 influence the crossbow or shape of the sheet 9 in its width direction at the location of the gas knife 4.

The shape of the metal sheet 9 or crossbow resulting from the effect of the sink roll 1 is a negative bow. A metal sheet 9 is said to have a negative bow if the bottom side of the metal sheet B is the concave side. When this happens, the coating thickness on the bottom side B of the metal sheet 9 is thicker in the middle than at its outer sides. Since the correction roll 2 bends the metal sheet 9 in the opposite direction of the sink roll 1, it has the tendency to create positive crossbow; while the stabilizer roll 3 bends the metal sheet 9 in the same direction as the sink roll 1 and therefore it has the tendency to create negative crossbow again. The final bow of the metal sheet 9 at the gas knife 4 is the combined result of these three consecutive bending operations.

Figure 2:
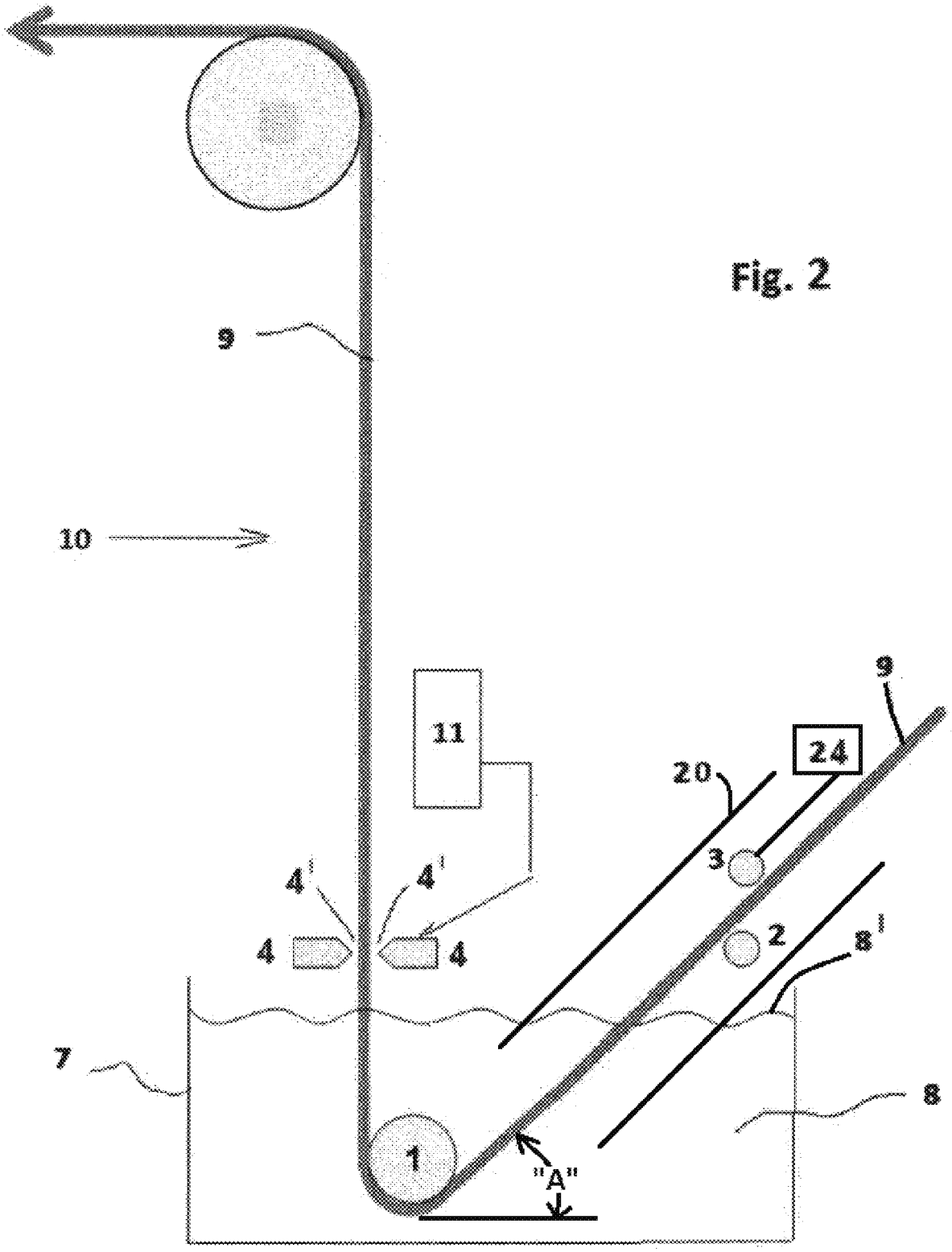
FIG. 2 shows a first embodiment of a hot dip coating device according to the invention.
Figure 3:
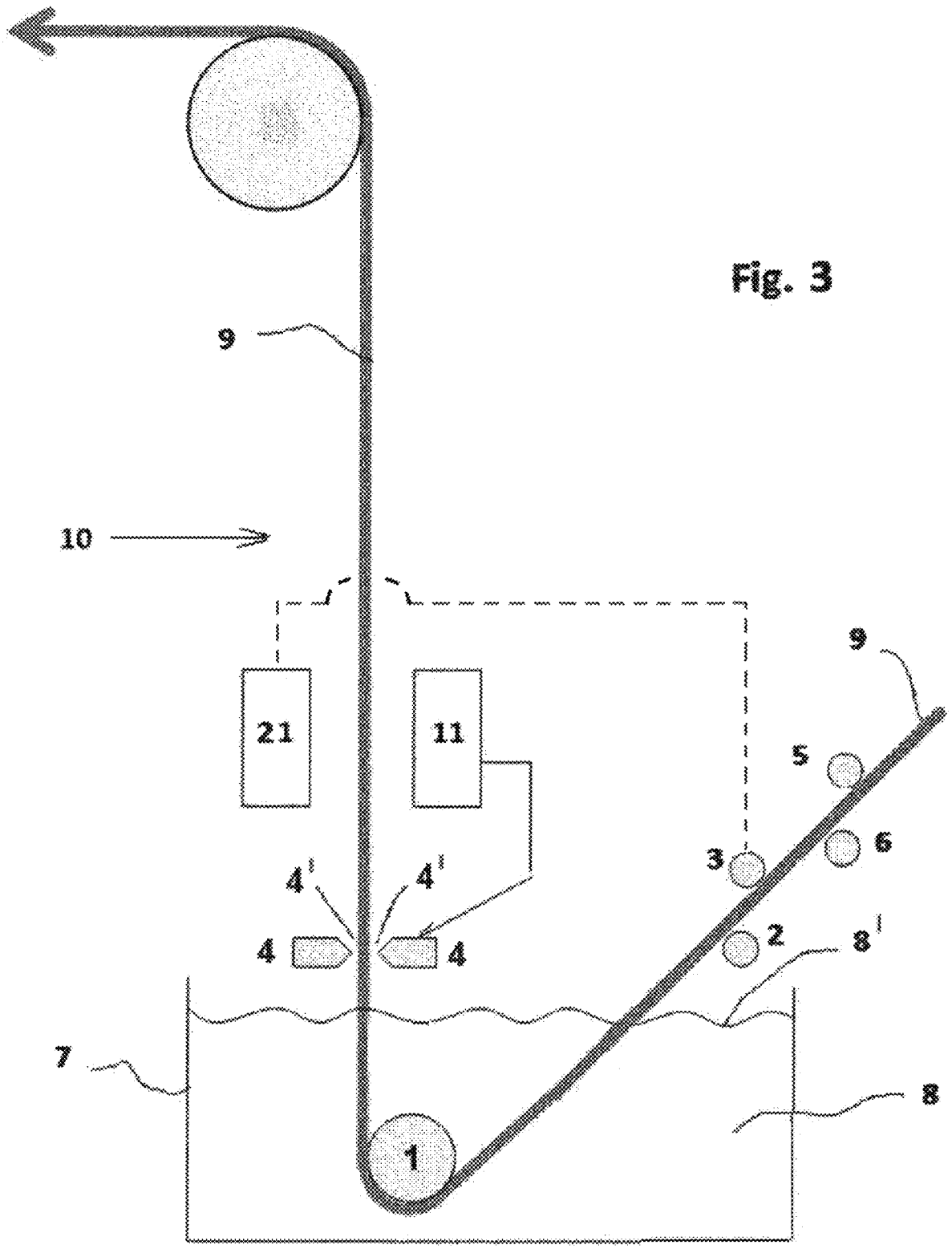
FIG. 3 shows a second embodiment of a hot dip coating device according to the invention.

FIG. 2 and FIG. 3 show two embodiments of the hot dip coating device 10 of the invention wherein the at least one supporting roll 2, 3 is positioned outside of the liquid bath 8, in particular wherein the rolls 2, 3 are positioned above surface level 8' of the liquid bath 8 on a position enabling it to operate on the metal sheet 9 before the metal sheet 9 enters the liquid metal bath 8.

The metal sheet 9 enters the liquid bath at an inclined angle "A". The position of the supporting rolls 2, 3 corresponds to where normally a snout 20 is provided through which the metal sheet 9 is moved before it enters into the liquid bath 8. The application of such a snout is entirely known to the skilled person and requires no further elucidation with reference to the drawing. Anyway, when such a snout is present it is preferable that the supporting roll or rolls 2, 3 are placed within the snout.

Schematically shown in the drawing is a preferred option wherein the at least one supporting roll 2, 3 is provided with a motor drive 24. The application of such a motor drive 24 for the supporting rolls 2, 3 requires no further elucidation with reference to the drawing since the manner in which this can be implemented is entirely clear for the skilled person.

Other preferable features are that the guide or sink roll 1 is movable vertically and/or horizontally in the liquid bath 8. In this way the positioning relative to the gas knife 4 and the positioning relative to the snout can be adjusted when the guide or sink roll wears. Likewise the gas knife 4 is preferably movable in the direction of the metal sheet 9. In this latter situation the gas knife 4 is advantageously provided with a positioning system 11 as shown in FIG. 2 to monitor the position of the passing metal sheet 9 and to align the gas knife 4 with the moving metal sheet 9.

When applying a snout it is further preferable that the at least one supporting roll 2, 3 is removably mounted within the snout to accommodate its replacement and/or maintenance.

As both FIG. 2 and FIG. 3 show the invention results in only the guide or sink roll 1 being present below surface level 8' of the liquid bath 8.

With reference again to FIG. 2 it is shown that the hot dip coating device 10 has two supporting rolls 2, 3, at least one of which should be arranged to be movable to and from the metal sheet 9.

Conversely FIG. 3 shows that it is also possible that the dip coating device 10 of the invention has four supporting rolls 2,3,5,6. The application of four supporting rolls as shown in FIG. 3 instead of (one or) two as shown in FIG. 2 is not arbitrary, but results in better achievements in terms of controllability of the crossbow of the metal sheet 9 as will be explained hereinafter.

Though not shown in a figure, it is also possible to use three supporting rolls 2, 3, 5, of which at least one should be movable to and from the moving metal sheet 9. The number of rolls that have to be used may be determined by the thickness of the metal sheet 9 and the velocity of the metal sheet 9.

According to the invention at least one of the supporting rolls 2, 3, 5, 6 has to be movable in the direction of the moving metal strip 9. In this way the crossbow of the metal strip 9 is influenced, and together with the influence by the guide or sink roll 1 the crossbow of the steel strip 9 at the position of the gas knife 4 is determined. The crossbow of the metal strip determines the thickness of the coating in travers direction, as elucidated above.

With reference to FIG. 4 and FIG. 5 the resulting crossbow for a different adjustment of the supporting rolls in the embodiments of FIG. 2 and FIG. 3 is analysed. Two different thicknesses of the metal sheet 9 are also considered, namely 0.7 mm and 1 mm. The results for the embodiment of FIG. 2 are shown in FIG. 4. As it is shown in this figure, the supporting rolls 2, 3 are capable to correct the crossbow created by the sink roll 1. With a particular position of the stabilization roll 3 there is always a range for the correction roll 2 adjustment that can be used to correct the crossbow caused by the sink roll 1. It can however be noted that the available range to provide corrective action is relatively narrow. This narrow range of the usable adjustment by correction roll 2 is indicated by the steep gradient in the graphs, wherein the horizontal upper and lower interrupted lines of the crossbow define the range wherein the metal strip 9 is deemed flat.

In comparison FIG. 5 shows the corresponding results when four supporting rolls 2, 3, 5, 6 are applied as shown in FIG. 3. With a position of the supporting roll 2 at 15 mm and 20 mm for a thickness of the metal sheet 9 of 0.7 mm and 1.0 mm respectively, and different adjustments of the supporting roll 3 as depicted by the graphs in FIG. 3, the graphs reveal that in combination therewith roll 6 can always be set at an adjustment value that ensures that the metal sheet 9 will be within the upper and lower limits of the range wherein the metal strip 9 is deemed flat.

The invention can be used for all types of coating using hot dip techniques, and is particularly useful for coating a metal sheet with zinc or zinc alloy, preferably a zinc aluminium alloy, zinc magnesium alloy or zinc aluminium magnesium alloy, or with aluminium or aluminium alloy, preferably an aluminium silicon alloy.

In an embodiment a device 21 for measuring the traverse shape of the coating is measured downstream of the gas knife 4. The measuring results can be used to control the adjustment of at least one of the rolls 2, 3, 5, 6, such that the coating thickness in transverse direction of the metal sheet 9 in improved in a closed loop, for instance using P, PI, PID or smith predictive control. Alternatively, it is possible to use a device 21 for measuring the traverse shape of the metal sheet 9 itself, and with the measuring results to control the crossbow of the metal sheet in a closed loop.

Although the invention has been discussed in the foregoing with reference to an exemplary embodiment of the hot dip coating device of the invention, the invention is not restricted to these particular embodiments which can be varied in many ways without departing from the invention. The discussed exemplary embodiments shall therefore not be used to construe the appended claims strictly in accordance therewith. On the contrary the embodiments are merely intended to explain the wording of the appended claims without intent to limit the claims to these exemplary embodiments. The scope of protection of the invention shall therefore be construed in accordance with the appended claims only, wherein a possible ambiguity in the wording of the claims shall be resolved using these exemplary embodiments.

The invention claimed is:

1. A hot dip coating device to provide a metal coating on a moving metal sheet having opposed first and second sides, containing a liquid bath of metal coating material to provide the metal coating on the moving metal sheet, comprising:

a container for the liquid bath, a guide or sink roll provided in the container below surface level of the liquid bath in use to guide the moving metal sheet through the bath, and a pair of gas knives provided above the liquid bath, each said gas knife having an outlet to project wiping gas on the metal coating provided on the moving metal sheet that passes along the gas knife, and wherein at least four supporting rolls are provided which together with the guide or sink roll influence a shape of the moving metal sheet in a width direction at least at a location of the gas knife, wherein the at least four supporting rolls are placed above the surface level of the liquid bath on a position enabling them to operate on the moving metal sheet before the moving metal sheet enters the liquid bath, wherein at least three of said at least four supporting rolls are moveable to and fro the moving metal sheet in a direction of the moving metal sheet to influence crossbow of the moving metal sheet as the moving metal sheet is moving;

wherein the at least four supporting rolls are adapted and configured for the moving metal sheet to be moved over the at least four supporting rolls before entering the liquid bath of metal in the container of the hot dip coating device, wherein the at least four supporting rolls are adapted and configured for at least two of the at least four supporting rolls to contact the first side of the moving metal sheet and at least two of the at least four supporting rolls to contact the second side of the moving metal sheet, wherein the at least four supporting rolls comprises a first supporting roll, a second supporting roll, a third supporting roll, and a fourth supporting roll, and wherein the fourth supporting roll is closest to the guide or sink roll and adapted and configured to contact a side of the moving metal sheet opposite to a side of the moving metal sheet that has contact with the guide or sink roll, and wherein the at least four supporting rolls are adapted and configured for contact with the opposed first and second sides of the moving metal sheet consisting of successive and alternate contact with the opposed first and second sides of the moving metal sheet relative to each other supporting roll of said at least four supporting rolls, wherein the second supporting roll is adapted and configured to contact the moving metal sheet successively and alternately relative to the first supporting roll, wherein the third supporting roll is adapted and configured to contact the moving metal sheet successively and alternately relative to the second supporting roll, wherein the fourth supporting roll is adapted and configured to contact the moving metal sheet successively and alternately relative to the third supporting roll;

wherein the third supporting roll is sufficiently separated from the second supporting roll such that the third supporting roll and the second supporting roll are each movable to and fro in the direction of the moving metal sheet to exert bending forces on the moving metal sheet to influence crossbow of the moving metal sheet;

wherein the fourth supporting roll is sufficiently separated from the third supporting roll such that the fourth supporting roll and the third supporting roll are each movable to and fro in the direction of the moving metal sheet to exert bending forces on the moving metal sheet to influence crossbow of the moving metal sheet;

wherein the second, third and fourth supporting rolls are sufficiently separated to independently and simultaneously exert penetration on the moving metal sheet;

wherein the hot dip coating device is adapted and configured to move the moving metal sheet, after passing the moving metal sheet between the first, second, third and fourth supporting rolls, into the liquid bath to contact the guide or sink roll provided in the container below the surface level of the liquid bath for guiding the moving metal sheet through the bath, wherein the hot dip coating device is adapted and configured to then move the moving metal sheet out of the liquid bath and then pass between the pair of said gas knives above the surface level of the liquid bath, each of the gas knife outlets for projecting wiping gas on the metal coating provided on the moving metal sheet that passes along the pair of gas knives;

wherein there is an absence of the at least four supporting rolls in the liquid bath of metal, wherein the hot dip coating device is adapted and configured to move the moving metal sheet along a path and a portion of the path of the moving metal sheet is inclined at an inclined angle such that the moving metal sheet moves into the liquid bath at the inclined angle, and the at least four supporting rolls are located along the inclined portion of the path of the moving metal sheet.

2. The hot dip coating device according to claim 1, comprising a snout through which the moving metal sheet moves into the liquid bath, wherein the at least four supporting rolls are placed within the snout.

3. The hot dip coating device according to claim 1, wherein at least one of the at least four supporting rolls is provided with a motor drive.

4. The hot dip coating device according to claim 1, wherein the gas knife is movable in a length direction of the hot dip coating device, the length direction being a traveling direction of the moving metal sheet.

5. The hot dip coating device according to claim 4, wherein at least one gas knife of the pair of gas knives is provided with a positioning system to position the at least one gas knife in relation to the moving metal sheet.

6. The hot dip coating device according to claim 1, wherein the guide or sink roll is movable vertically and/or horizontally in the liquid bath.

7. The hot dip coating device according to claim 2, wherein the at least four supporting rolls are removably mounted within the snout to accommodate replacement and/or maintenance.

8. The hot dip coating device according to claim 1, wherein in use the guide or sink roll is an only roll below the surface level of the liquid bath.

9. The hot dip coating device according to claim 1, wherein the container is adapted and configured for the liquid bath of metal to be a liquid bath of zinc aluminium alloy, zinc magnesium alloy or zinc aluminium magnesium alloy.

10. The hot dip coating device according to claim 1, wherein the container is adapted and configured for the liquid bath of metal to be a liquid bath of aluminium silicon alloy.

* * * * *